United States Patent [19]

Leggio

[11] Patent Number: 5,000,340

[45] Date of Patent: Mar. 19, 1991

[54] APPARATUS FOR RETAINING AND SEQUENTIALLY DISPENSING TRASH CONTAINER LINERS FOR A TRASH CONTAINER

[76] Inventor: Laurie K. Leggio, 119 Coral Ave., Balboa Island, Calif. 92662

[21] Appl. No.: 576,962

[22] Filed: Sep. 4, 1990

[51] Int. Cl.[5] ..... B65D 85/00

[52] U.S. Cl. ..... 220/407; 220/908

[58] Field of Search ..... 220/407, 908

[56] References Cited

U.S. PATENT DOCUMENTS

| | | | |
|---|---|---|---|
| 3,300,082 | 1/1967 | Patterson | 220/407 X |
| 3,392,825 | 7/1968 | Gale et al. | 220/407 X |
| 3,451,453 | 6/1969 | Heck | 220/407 X |
| 3,760,975 | 9/1973 | Nilsson | 220/407 X |
| 3,800,503 | 4/1974 | Maki | 220/407 X |
| 4,721,226 | 1/1988 | Yurko | 220/407 |
| 4,798,363 | 1/1989 | Cortesi | 220/407 X |
| 4,823,979 | 4/1989 | Clark, Jr. | 220/407 |
| 4,850,507 | 7/1989 | Lemongelli et al. | 220/407 |
| 4,850,508 | 7/1989 | Lee | 220/407 |
| 4,955,505 | 9/1990 | Battaglia | 220/407 |

*Primary Examiner*—Steven M. Pollard

*Attorney, Agent, or Firm*—Thomas I. Rozsa

[57] ABSTRACT

An apparatus for retaining and sequentially dispensing liners for trash containers. The liners for a trash container are formed into a continuous roll wherein one liner is separated from an adjacent liner by a frangible score line so that one liner container be torn off the roll of liners. The dispensing apparatus is a generally hollow cylindrical container which conforms to the shape of the roll of trash container liners and has a centrally disposed opening through which the forwardmost or uppermost liner container be threaded. The dispensing apparatus further includes a fixture for retaining the dispensing apparatus at the bottom of a trash container so that trash container liners container be sequentially pulled out of the container. With the trash container liner anchored at the bottom of the container through the affixed dispensing apparatus, the apparatus holds the bottom of the trash container liner adjacent the bottom of the trash container and through which the open ends of the liner container be spread over the rim of the trash container. When the trash container liner is full, the liner is merely closed and tied at the top and pulled out of the trash container. The pulling action serves to bring the next attached unused trash container liner into the usable position and the filled trash container liner is torn away from the next unused trash container liner at the adjoining score line between the two liners.

2 Claims, 1 Drawing Sheet

APPARATUS FOR RETAINING AND SEQUENTIALLY DISPENSING TRASH CONTAINER LINERS FOR A TRASH CONTAINER

BACKGROUND OF THE INVENTION

1. Field of the Invention

The present invention relates to the field of receptacles for holding objects and in particular for holding trash and waste. The present invention further relates to the field of liners for trash containers into which objects to be discarded are placed. The present invention additionally relates to the field of disposable trash container liners and to apparatus which are used to retain and dispense such trash container liners.

2. Description of the Prior Art

In general, trash container liners are well known in the prior art. Such liners frequently come in packages in which the individual liners may be removed from a box or carton and thereafter opened and placed into the trash container such as a garbage can. A major flaw with prior art trash container liners is that they must be individually opened and placed in the garbage container. Frequently, during a busy work schedule, people forget to place such trash container liners in the garbage container or alternatively merely drop them into the garbage container without properly affixing the liners to the rim of the garbage container so that the trash container liner is not fully opened and ready to receive garbage. Since such liners must be stored in closets or other locations remote from the garbage container, forgetting to use the liner is a frequent occurrence.

Ordinarily not using the trash container liner or installing it improperly is not a major problem since the only negative result is that trash goes directly into the garbage container, thereby causing the container to become dirty and necessitating a thorough washing of the container. However, in situations where the trash container is used in facilities such as a hospital or nursing home, the problem becomes much more serious. In hospitals and nursing homes, contaminated objects such as used bandages and gauze, used syringes, etc. are thrown into the garbage container. If a trash container liner is properly installed, then the cleaning person merely lifts up the liner and ties it at the top and discards it, without having to touch any of the contaminated objects. However, if the liner is not used or if it is not properly installed and contaminated trash is thrown directly into the trash container, then the cleaning person frequently must touch the contaminated object to throw it into a disposal unit or else wash and clean the garbage container interior which has come in direct contact with the contaminated material, thereby risking infection and possible contraction of disease.

Therefore, there is a significant need for an object which can create a situation where the trash container liner is located in a manner which will always cause it to be used to line the interior of trash containers and further be oriented such that the trash container liner can also be properly installed in the trash container.

SUMMARY OF THE PRESENT INVENTION

The present invention relates to a novel apparatus for retaining and sequentially dispensing liners for trash containers. The liners for a trash container are formed into a continuous roll wherein one liner is separated from an adjacent liner by a frangible scored line so that one liner can be torn off the roll of liners. The dispensing apparatus is a generally hollow cylindrical container which conforms to the shape of the roll of trash container liners and has a centrally disposed opening through which the forwardmost or uppermost liner can be threaded. The dispensing apparatus further comprises means to retain the dispensing apparatus at the bottom of a trash container so that trash container liners can be sequentially pulled out of the container. With the trash container liner anchored at the bottom of the container through the affixed dispensing apparatus, the apparatus forms a holding means to retain the bottom of the trash container liner adjacent the bottom of the trash container and through which the open ends of the liner can be spread over the rim of the trash container. When the trash container liner is full, the liner is merely closed and tied at the top and pulled out of the trash container. The pulling action serves to bring the next attached unused trash container liner into the usable position and the filled trash container liner is torn away from the next unused trash container liner at the adjoining score line between the two liners. The next unused trash container liner is similarly anchored at its bottom by the dispensing apparatus and the open end which was adjacent the frangible score line is spread open over the rim of the trash container.

It has been discovered, according to the present invention, that if a dispensing apparatus comprises a hollow interior which houses a multiplicity of attached trash container liners which are sequentially attached to adjacent liners through a frangible score line, and the dispensing apparatus comprises an opening through which the liners can be sequentially pulled from the interior of the dispensing apparatus, then the dispensing apparatus can be used to sequentially dispense trash container liners.

It has further been discovered, according to the present invention that if the dispensing apparatus is affixed to the bottom of the trash container, then the dispensing apparatus serves to act as an anchor by which the bottom of the individual liner in use is held adjacent the bottom of the trash container while the open top of the liner is spread over the rim of the trash container to thereby open the liner to receive trash.

It has additionally been discovered, according to the present invention, that if the dispensing apparatus is attached to the bottom of the trash container by means such as hook and loop fasteners such as VELCRO ®R, then after the liners in a given dispensing apparatus have been used up, the dispensing apparatus can be removed and a fresh dispensing apparatus with a fresh roll of liners inserted.

It has further been discovered that while a cylindrical roll with a cylindrical dispensing apparatus is the preferred embodiment, other sheet shapes of liners such as rectangular with conformed rectangular dispensing apparatus configurations are also within the spirit and scope of the present invention.

It is therefore an object of the present invention to provide a means for sequentially dispensing a multiplicity of trash container liners in a manner by which the liners can be quickly and efficiently fitted within the interior of the trash container and with the top of the liners spread over the rim of the trash container so that the liner is in the fully opened position to receive trash.

It is another object of the present invention to provide a means by which trash container liners can be sequentially configured so that as soon as one liner is filled, it can be closed and the next suceeding liner immediately opened and quickly and efficiently placed into operation.

It is a further object of the present invention to provide a dispensing apparatus and liners of any desired size and shape to accommodate any multiplicity of different size and shape trash containers.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENT

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

Figure 1:
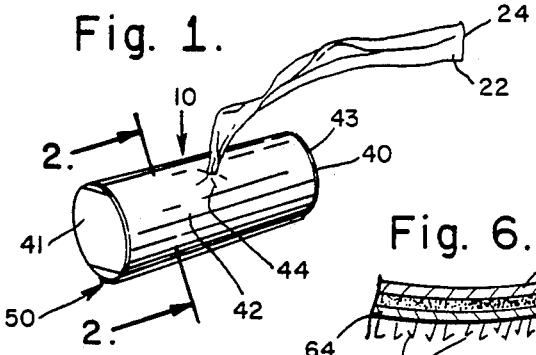
FIG. 1 is a perspective view of the present invention apparatus for retaining and sequentially dispensing liners for trash containers, with one liner partially removed from the dispensing apparatus.
Figure 2:
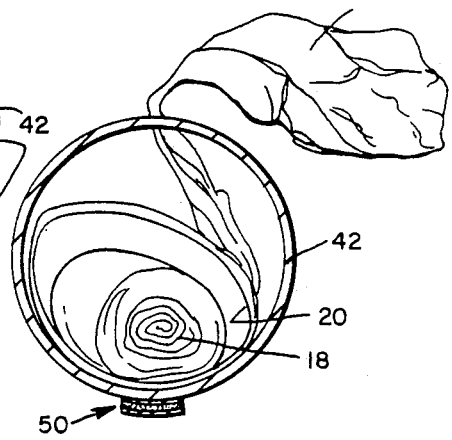
FIG. 2 is a cross-sectional view taken along line 2—2 of FIG. 1.
Figure 5:
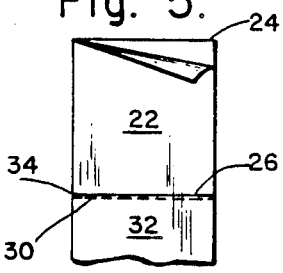
FIG. 5 is an elevational view of two adjacent trash can liners.

Referring to FIGS. 1, 2, and 5, there is shown at 10 the present invention apparatus for retaining and sequentially dispensing liners for trash containers. In the preferred embodiment, a multiplicity of trash container liners 20 is wound into a roll 18. Each trash container liner, for example the first trash container liner 22 illustrated in FIG. 5 has an open end 24 and a closed end 26. At its closed end 26, trash container liner 22 is attached to the open end 34 of adjacent trash container liner 32 by a frangible score line 30 so that trash container liner 22 can be separated from trash container liner 32 when desired by tearing along the frangible score line. It will be appreciated that the multiplicity of trash container liners 20 is comprised of liners which are attached to adjacent liners in this manner. It will also be appreciated that while the embodiment wherein the multiplicity of trash container liners 20 are wound into a roll 18, other embodiments such as folding a multiplicity of trash container liners into a rectangular package or similar embodiments are also within the spirit and scope of the present invention.

The multiplicity of trash container liners 20 are placed into a housing 40 which preferably conforms to the shape of the roll 18 and is therefore cylindrical as illustrated in FIG. 1. The housing has an exterior surface 42 and is closed at both ends 41 and 43. The housing 40 further comprises an opening 44 in its surface 42 through which the multiplicity of trash container liners 20 are sequentially pulled or dispensed, one at a time, with the open end emanating from the housing first. In this manner, the weight of the housing 40 and the roll 18 acts as an anchor to hold the closed end such as 26 of trash container liner 22 adjacent the housing 40 while the open end 24 can be remote from the housing 40.

Figure 6:
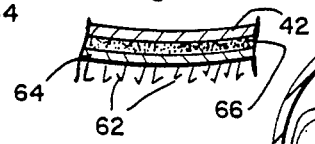
FIG. 6 is a perspective view of the first mating means of present invention.
Figure 3:
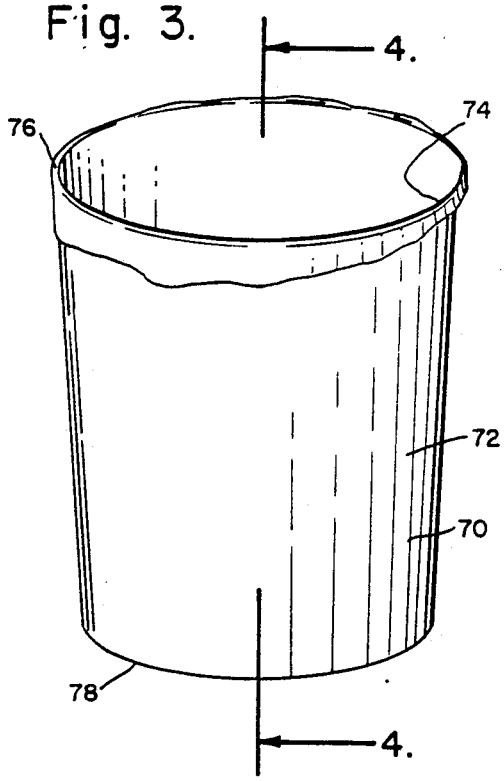
FIG. 3 is a perspective view of the present invention apparatus for retaining and sequentially dispensing liners for trash containers, with one liner in its operative position lining the interior of a trash container with the open end draped over the top of the trash container.
Figure 4:
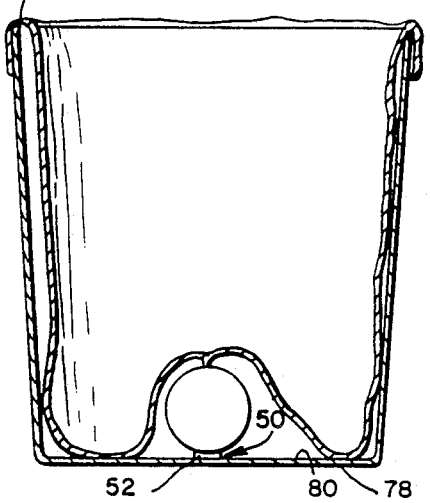
FIG. 4 is a cross-sectional view taken along line 4—4 of FIG. 3.
Figure 7:
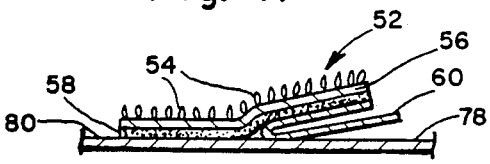
FIG. 7 is a perspective view of the second mating means of the present invention.

Another important feature of the present invention is attaching means by which the trash container liner housing 40 can be attached to the bottom of the trash container. A conventional trash container 70 is illustrated in FIGS. 3 and 4. The trash container 70 comprises a container wall 72 having an open top 74 bounded by upper rim 76 and a lower closed bottom 78 having an interior surface 80. In the preferred embodiment, the means for attaching can be mating hook and loop fasteners such as VELCRO®R. Referring to FIGS. 2, 4 and 6, the bottom of the housing 40 comprises a first mating means 50. By way of example, referring to FIG. 6, the first mating means may have the hook fastener 62 attached to the surface 64 which in turn has adhesive means 66 by which it is attached to the surface 42 of housing 40. A second mating means 52 is attached to the interior surface 80 of trash container bottom 78. By way of example, referring to FIG. 7, the second mating means 52 may comprise loop fasteners 54 attached to a surface 56 which has adhesive means 58 on its underside and which adhesive means 58 is covered by a peel away protective strip 60. In use, the peel away strip 60 is peeled away from the adhesive means 58 and the second mating means 52 is affixed to the interior surface 80 of trash container bottom 78 by placing the adhesive means 58 and surface 56 onto the interior surface 80. Preferably, the second mating means 52 is aligned diagonally along a centerline on the interior surface 80 to be centrally disposed along the interior bottom 80. The first mating means 50 which by way of example can be hook fasteners 62 which are affixed to the housing 40 can be removably joined to the loop fasteners. In the preferred embodiment, the first mating means 50 is oppositely disposed to the opening 44 in the housing so that when the housing is attached to the interior trash container bottom by the first and second mating means, the opening 44 is centrally disposed within the trash container 70.

With the housing 40 attached in this manner, the trash container liners 20 can be pulled out of opening 44 and opened such that the closed end 26 of first liner 22 is adjacent the opening 44 of housing 40 and the housing 40 acts as an anchor to retain the closed end 26 adjacent the bottom 78 of trash container 70 while the open end 24 is spread out over the rim 76 of trash container 70 so that all trash is deposited into the trash container liner 22. When trash container liner 22 is filled, the open end 24 is placed together and tied with a trash container liner tie in the conventional and well known manner. The filled trash container lever 22 is then pulled out of the trash container 70 and in the process of doing so, the next trash container liner 32 is pulled into place with its bottom 36 adjacent the opening 44 in housing 40. The trash container liner 22 is separated from the next trash container liner 32 along frangible score line 30 and the open end 34 of trash container liner 32 is then spread over rim 76 of trash container 70 so that the new trash container liner 32 is ready to receive trash. In this manner, the trash container liners 20 can be successively pulled out and automatically placed into operation with the closed end anchored adjacent the bottom of the trash container and the open end ready to be affixed around the upper rim of the trash container.

Therefore, the present invention provides an extremely efficient way to retain trash container liners and have them ready for operational use. When all of the trash container liners 20 in a housing have been used up, then the housing can be removed since a force can separate the hook and loop fasteners and a new housing affixed to the mating loop fastener on the trash container bottom.

It will be appreciated that the mating members can be reversed so the first mating means 50 affixed to the housing 44 can have loop fasteners while the second mating means 52 affixed to the interior bottom surface of the trash container may be hook fasteners. Additionally, other types of fastening means such as mating snaps may be used in place of the hook and loop fastening means.

The housing 40 can be made of any conventional material such as cardboard, plastic, etc. The roll of trash container liners 20 can be loosely placed inside the housing 40 or can be wound on an interior drum. Any suitable shape for the housing which permits it to be inserted into a trash container and which permits the multiplicity of trash container liners to be fed from it is within the spirit and scope of the present invention.

While in the preferred embodiment the hollow housing 40 is affixed to the interior surface on the bottom of the trash container 70, it is within the spirit and scope of the present invention to affix the hollow housing 40 anywhere within the trash container 70.

Therefore, the present invention can be defined as an apparatus for retaining and sequentially dispensing trash container liners for a trash container having an exterior wall, an open end bounded by a rim from the exterior wall, an interior chamber, and a bottom wall having an interior surface facing the interior chamber, the apparatus comprising: (a) a multiplicity of trash container liners arranged in a series, each trash container liner having an open end and a closed end, and attached to each adjacent trash container liner at one of its ends, with the first trash container liner in the series only attached to the adjacent trash container liner at its closed end and the last trash container liner in the series attached to the adjacent trash container liner at only its open end; (b) a hollow container having an exterior wall bounding an interior chamber, and having an opening in the exterior wall leading to the interior chamber; (c) said multiplicity of trash container liners retained within the interior chamber of said hollow container, with the first trash container liner extending through the opening in the exterior wall of said hollow container; and (d) a retaining means for removably retaining the hollow container on the interior surface of the bottom of the trash container; (e) whereby said hollow container is removably retained on the interior lower surface of the trash container and acts as an anchor to retain the closed end of a trash container liner in use adjacent the bottom of the trash container while the open end of the trash container liner in use is spread on the rim of the trash container.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus is intended only for illustration and for disclosure of an operative embodiment and not to show all of the various forms of modification in which the invention might be embodied or operated.

The invention has been described in considerable detail in order to comply with the patent laws by providing full public disclosure of at least one of its forms. However such detailed description is not intended in any way to limit the broad features or principles of the invention or the scope of patent monopoly to be granted.

What is claimed is:

1. An apparatus for retaining and sequentially dispensing trash container liners for a trash container having an exterior wall, an open end bounded by a rim from the exterior wall, an interior chamber, and a bottom wall having an interior surface facing the interior chamber, the apparatus comprising:

a. a multiplicity of trash container liners arranged in a series and formed into a cylindrical roll, each trash container liner having an open end and a closed end, and attached to each adjacent trash container liner at one of its ends, with the first trash container liner in the series only attached to the adjacent trash container liner at its closed end and the last trash container liner in the series only attached to the adjacent trash container liner at its open end;

b. a cylindrical hollow container having an exterior wall bounding a cylindrical interior chamber, and having an opening in the exterior wall leading to the cylindrical interior chamber;

c. said roll of multiplicity of trash container liners retained within the cylindrical interior chamber of said cylindrical hollow container, with the first trash container liner extending through the opening in the exterior wall of said cylindrical hollow container;

d. a retaining means for removably retaining the cylindrical hollow container on the interior surface of the bottom of the trash container;

e. said retaining means further comprising, (i) a hook type fastening means affixed to the exterior wall of said hollow container at a location diametrically opposite to the opening in said cylindrical hollow container; and (ii) a loop type fastening means affixed to the interior surface of the bottom of said trash container along the center of the interior surface;

f. whereby said cylindrical hollow container is removably retained on the interior lower surface of the trash container and acts as an anchor to retain the closed end of a trash container liner in use adjacent the bottom of the trash container while the open end of the trash container liner in use is spread on the rim of the trash container.

2. An apparatus for retaining and sequentially dispensing trash container liners for a trash container having an exterior wall, an open end bounded by a rim from the exterior wall, an interior chamber, and a bottom wall having an interior surface facing the interior chamber, the apparatus comprising:

a. a multiplicity of trash container liners arranged in a series and formed into a cylindrical roll, each trash container liner having an open end and a closed end, and attached to each adjacent trash container liner at one of its ends, with the first trash container liner in the series only attached to the adjacent trash container liner at its closed end and the last trash container liner in the series only attached to the adjacent trash container liner at its open end;

b. a cylindrical hollow container having an exterior wall bounding a cylindrical interior chamber, and having an opening in the exterior wall leading to the cylindrical interior chamber;

c. said roll of multiplicity of trash container liners retained within the cylindrical interior chamber of said cylindrical hollow container, with the first trash container liner extending through the opening in the exterior wall of said cylindrical hollow container;

d. a retaining means for removably retaining the cylindrical hollow container on the interior surface of the bottom of the trash container;

e. said retaining means further comprising, (i) a loop type fastening means affixed to the exterior wall of said hollow container at a location diametrically opposite to the opening in said cylindrical hollow container; and (ii) a hook type fastening means affixed to the interior surface of the bottom of said trash container along the center of the interior surface;

f. whereby said cylindrical hollow container is removably retained on the interior lower surface of the trash container and acts as an anchor to retain the closed end of a trash container liner in use adjacent the bottom of the trash container while the open end of the trash container liner in use is spread on the rim of the trash container.

* * * * *